US010486162B2

(12) United States Patent
Alberts et al.

(10) Patent No.: US 10,486,162 B2
(45) Date of Patent: Nov. 26, 2019

(54) FOOD WASTE DISPOSER NOISE REDUCTION USING ACTIVE NOISE CONTROL

(71) Applicant: EMERSON ELECTRIC CO., St. Louis, MO (US)

(72) Inventors: Samuel Alberts, Milwaukee, WI (US); Thomas R. Berger, Racine, WI (US)

(73) Assignee: EMERSON ELECTRIC CO., St. Louis, MO (US)

( * ) Notice: Subject to any disclaimer, the term of this patent is extended or adjusted under 35 U.S.C. 154(b) by 297 days.

(21) Appl. No.: 15/523,993

(22) PCT Filed: Oct. 28, 2015

(86) PCT No.: PCT/US2015/057770

§ 371 (c)(1),
(2) Date: May 3, 2017

(87) PCT Pub. No.: WO2016/073254

PCT Pub. Date: May 12, 2016

(65) Prior Publication Data

US 2017/0358290 A1 Dec. 14, 2017

Related U.S. Application Data

(60) Provisional application No. 62/074,257, filed on Nov. 3, 2014.

(51) Int. Cl.
*B02C 18/00* (2006.01)
*E03C 1/266* (2006.01)
(Continued)

(52) U.S. Cl.
CPC ..... *B02C 18/0092* (2013.01); *B02C 18/16* (2013.01); *B02C 18/2225* (2013.01);
(Continued)

(58) Field of Classification Search
CPC . B02C 18/0092; B02C 18/2225; B02C 18/16; B02C 23/16; G10K 11/178; G10K 11/1785; G10K 11/17881; G10K 11/175
(Continued)

(56) References Cited

U.S. PATENT DOCUMENTS 3,739,992 A 6/1973 Bebinger
3,901,349 A * 8/1975 DeNoyer ..... G10K 11/172 181/200

(Continued)

FOREIGN PATENT DOCUMENTS

CA 2606442 A1 4/2008
EP 0415237 A2 3/1991

(Continued)

OTHER PUBLICATIONS

First Examination Report regarding NZ App. No. 731705, dated Sep. 22, 2017.

(Continued)

*Primary Examiner* — Faye Francis
(74) *Attorney, Agent, or Firm* — Harness, Dickey & Pierce, P.L.C.

(57) ABSTRACT

A food waste disposer system (300) has active noise control of food waste disposer noise that is generated by the food waste disposer (302) when a motor of the food waste disposer (302) is running. The food waste disposer (302) has a food conveying section that conveys food waste to a grinding section. The grinding section has a rotatable shredder plate that is rotated by a motor of a motor section. Active noise sound waves (310) are radiated into an area (313) where the food waste disposer noise is to be controlled at an amplitude and frequency to at least cancel or mask the food waste disposer noise.

22 Claims, 8 Drawing Sheets

(51) Int. Cl.
*G10K 11/178* (2006.01)
*B02C 18/16* (2006.01)
*B02C 18/22* (2006.01)

(52) U.S. Cl.
CPC ..... *E03C 1/2665* (2013.01); *G10K 11/178* (2013.01); *G10K 2210/105* (2013.01); *G10K 2210/119* (2013.01); *G10K 2210/121* (2013.01)

(58) Field of Classification Search
USPC ..... 241/46.013
See application file for complete search history.

(56) References Cited

U.S. PATENT DOCUMENTS

| | | | | |
|---|---|---|---|---|
| 6,719,228 | B2 * | 4/2004 | Berger | E03C 1/2665 241/46.016 |
| 6,768,799 | B1 | 7/2004 | Thomas | |
| 7,331,539 | B2 * | 2/2008 | Jara-Almonte | E03C 1/2665 241/46.014 |
| 2003/0066914 | A1 * | 4/2003 | Jara-Almonte | E03C 1/2665 241/46.013 |
| 2009/0282874 | A1 | 11/2009 | Lee et al. | |

FOREIGN PATENT DOCUMENTS

| | | | |
|---|---|---|---|
| EP | 2860544 | A2 | 4/2015 |
| FR | 1306428 | A | 10/1962 |
| WO | WO-2002059497 | A2 | 8/2002 |

OTHER PUBLICATIONS

"Silentium ANC Workshop", http://www.acousticontrol.com/silentium-active-noise-reduction.html (which was published via the Internet Archive: Waybackmachine https://archive.org/web/), May 2013.

International Search Report and Written Opinion of the International Searching Authority for PCT/US2015/057770 dated Feb. 2, 2016.

* cited by examiner

FOOD WASTE DISPOSER NOISE REDUCTION USING ACTIVE NOISE CONTROL

CROSS-REFERENCE TO RELATED APPLICATIONS

This application is a 371 National Phase application of PCT/US2015/057770, filed on Oct. 28, 2015 and published as WO 2016/073254 A1 on May 12, 2016, which claims the benefit of U.S. Provisional Application No. 62/074257 filed Nov 3, 2015. The entire disclosures of the above applications are incorporated herein by reference.

FIELD

The present disclosure relates to food waste disposers, and more particularly, to food waste disposer noise reduction using active noise control.

BACKGROUND

This section provides background information related to the present disclosure, which is not necessarily prior art.

A food waste disposer of the type that is disposed underneath a sink and is mounted to a drain opening of the sink typically includes a food conveying section, a motor section and a grind section. The grind section is disposed between the food conveying section and the motor section. The food conveying section conveys food waste and water to the grind section. The grind section receives and grinds the food waste and the ground food waste is discharged through a discharge opening to a tailpipe.

The grind section typically includes a grind mechanism with a rotating shredder plate assembly and a stationary grind ring. The shredder plate assembly is connected to a shaft of an electric motor of the motor section and includes a shredder plate with one or more lugs, typically one or more pairs of lugs. The lugs may include fixed lugs that are fixed to the shredder plate, rotatable lugs (also called swivel lugs) that are rotatably fastened to the shredder plate and are free to rotate thereon, or both. The shredder plate is rotated relative to the grind ring via the electric motor. The grind ring is typically mounted in a housing and includes multiple spaced teeth.

The operational noise of a food waste disposer is a combination of grinding noise, water spectrum, and motor noise. Grinding noise arises from the interaction of the food waste with the grind mechanism components and the container body. It is characterized by random impulsive noise events from impacts and it changes over time as the food waste is broken up and discharged to the drain line. The water spectrum noise arises from the running water exiting the faucet, impinging upon the sink, and being moved about within the food waste disposer. Motor noise is typically a steady state noise with a consistent frequency content but it can vary from unit to unit as the characteristics of motor noise are highly affected by bearing alignment and variations in rotor/stator air gap.

Passive noise control is currently used to reduce the operational noise levels of food waste disposers. Passive methods include the use of (1) absorbent and barrier materials to absorb and/or block sound energy traveling through the container body or motor housing, (2) vibration isolation mounts at the sink and plumbing interfaces to reduce structure borne noise from the sink and plumbing, and (3) use of baffling at the throat opening to attenuate air borne noise from the grind chamber. Passive methods have been effective in reducing the noise levels perceived by the user during operation of the food waste disposer. However, there are practical constraints to how much noise reduction can be achieved by these means, especially in frequency ranges 1 kHz and lower.

FIG. 1 depicts a prior art food waste disposer 100 which is similar to the prior art food waste disposer described in U.S. Pat. No. 7,360,729 the entire disclosure of which is incorporated herein by reference. The disposer includes an upper food conveying section 102, a central grinding section 104 and a motor section 106, which may include a variable speed motor. It should be understood that motor section 106 could also include a fixed speed motor, such as an induction motor. The grinding section 104 is disposed between the food conveying section 102 and the motor section 106.

The food conveying section 102 conveys the food waste to the grinding section 104. The food conveying section 102 includes an inlet housing 108 and a conveying housing 110. The inlet housing 108 has an inlet 109 at the upper end of the food waste disposer 100 for receiving food waste and water. Inlet 109 is surrounded by a gasket 111. The inlet housing 108 is attached to the conveying housing 110, such as by an antivibration mount 113.

The conveying housing 110 has an opening 142 to receive a dishwasher inlet 144. The dishwasher inlet is used to pass water from a dishwasher (not shown). The inlet housing 108 and conveying housing 110 may be made of metal or molded plastic. Alternatively, inlet housing 108 and conveying housing 110 may be one unitary piece.

The grinding section 104 includes a housing 112 surrounding a grinding mechanism 114 having a rotating shredder plate assembly 116 and a stationary grind ring 118. Housing 112 is formed as a clamp ring and clamps conveying housing 110 to an upper end bell 136 of motor section 106. Stationary grind ring 118, which includes a plurality of spaced teeth 120 (only two of which are indicated by reference number 120 in FIG. 1), may be received in an adaptor ring 122 disposed between housing 112 and stationary grind ring 118. A gasket 123 is disposed between adaptor ring 122 and an upper portion 125 of housing 112. A bottom flange 127 of conveying housing 110 is received in gasket 123 and gasket 123 seals conveying housing 110 to adaptor ring 122.

The rotating shredder plate assembly 116 may include a rotating shredder plate 124 mounted to a rotatable shaft 126 of a motor 128 of motor section 106, such as by a bolt 130. Motor 128 also includes a rotor 129 to which rotatable shaft 126 is affixed and a stator 131. A plurality of fixed lugs 132 (only one of which is shown in FIG. 1) are mounted on rotating shredder plate 124 as are a plurality of swivel lugs 134 (only one of which is shown in FIG. 1). It should be understood that in this regard, rotating shredder plate assembly 116 could include only fixed lugs 132 or only swivel lugs 134.

An upper end bell 136 is disposed beneath a bottom of rotating shredder plate 124. Upper end bell 136 includes a discharge chamber 140 having a discharge outlet 141 for coupling to a tailpipe or drainpipe (not shown).

In an aspect, food waste disposer 100 may include a trim shell 146 that surrounds food conveying section 102, grinding section 104 and motor section 106. A layer of sound insulation 148 may be disposed between trim shell 146 and conveying housing 110 of food conveying section 102 and housing 112 of grinding section 104.

Food waste disposers such as food waste disposer 100 are often generally installed to a sink in a two-step procedure using a mounting assembly 200 of the type described in U.S. Pat. No. 9,139,990. With reference to FIG. 2, first, a sink flange assembly 202, consisting of a sink flange 204, sink gasket 206, back-up flange 208, upper mounting flange 210, bolts 212, and retaining ring 214 are installed to the sink (not shown). Second, a disposer assembly consisting of a disposer such as disposer 100 (FIG. 1), a mounting gasket 216 (which is mounting gasket 111 in FIG. 1), and a lower mounting flange 218 are attached to the sink flange assembly. Lower mounting flange 218 is placed around inlet housing 108 of food conveying section 102 so that it is beneath inlet 109. Mounting gasket 216 is then placed around inlet 109. Inlet housing 108 of food conveying section 102 includes circumferential lip 188 extending around the circumference of inlet 109. Lip 188 is received in a corresponding recess (not shown) in mounting gasket 216 to secure mounting gasket 216 to food waste disposer at inlet 109. The attachment method, as described in U.S. Pat. No. 9,139,990, consists of engaging the mounting tabs 220 of the lower mounting flange 218 with the inclined mounting ramps 222 of the upper mounting flange 210 then rotating the lower mounting flange 218 until secure. The typical installation method involves raising the disposer 100 and mounting components to the sink flange assembly 202 with one hand then with the other hand lifting the lower mounting flange 218 and rotating to engage its mounting tabs 220 to the mounting ramps 222 of upper mounting flange 210. Rotating the lower mounting flange 218 brings it and upper mounting flange 210 securely together, compressing the mounting gasket 216 therebetween, and secures the disposer 100 to the sink flange assembly 202.

In the operation of the food waste disposer 100, the food waste delivered by the food conveying section 102 to the grinding section 104 is forced by lugs 132, 134 of the rotating shredder plate assembly 116 against teeth 120 of the stationary grind ring 118. The sharp edges of the teeth 120 grind or comminute the food waste into particulate matter that combines with water, such as water that entered the food waste disposer through inlet 109, to form a slurry that drops into discharge chamber 140. This slurry is then discharged through the discharge outlet 141 into the tailpipe or drainpipe (not shown).

SUMMARY

This section provides a general summary of the disclosure, and is not a comprehensive disclosure of its full scope or all of its features.

A food waste disposer system has active noise control of food waste disposer noise that is generated by the food waste disposer when a motor of the food waste disposer is running. The food waste disposer has a food conveying section that conveys food waste to a grinding section. The grinding section has a rotatable shredder plate that is rotated by a motor of a motor section. Active noise sound waves are radiated into an area where the food waste disposer noise is to be controlled at an amplitude and frequency to at least cancel or mask the food waste disposer noise.

In an aspect, the active noise sound waves are radiated at an amplitude and a frequency to both cancel and mask the food waste disposer noise.

In an aspect, the active noise sound waves are radiated into an interior of the food conveying section of the food waste disposer. In an aspect, the active noise sound waves are radiated from a portion of an active noise source that extends through a wall of a housing of the food conveying section. In an aspect, the active noise sound waves are radiated from an active noise source disposed in a stopper received in a sink drain outlet of a sink to which the food waste disposer is mounted.

In an aspect, the active noise sound waves are radiated into an interior of a tubular body portion of a sink flange to which the food waste disposer is mounted. In an aspect, the active noise sound waves are radiated from a portion of an active noise source that extends through a wall of the tubular body portion of the sink flange.

In an aspect, the area is above an inlet at an upper end of the food waste disposer and the active noise sound waves are radiated to the area above the inlet at the upper end of the food waste disposer from an active noise source disposed in a stopper received in a sink drain outlet of a sink to which the food waste disposer is mounted.

In an aspect, the active noise sound waves are radiated in an interior of a cabinet in which the food waste disposer is disposed. In an aspect, the active noise sound waves are radiated by an active noise source disposed in the cabinet.

In an aspect, the active noise sound waves are generated by vibrating a wall of a sink to which the food waste disposer is mounted.

In an aspect, the active noise sound waves are generated by vibrating a wall of the cabinet in which the food waste disposer is disposed In an aspect, the active noise are generated by vibrating a wall of a conveying housing of a food conveying section of the food waste disposer or vibrating a wall of a tubular body portion of a sink flange to which the food waste disposer is mounted.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 9:
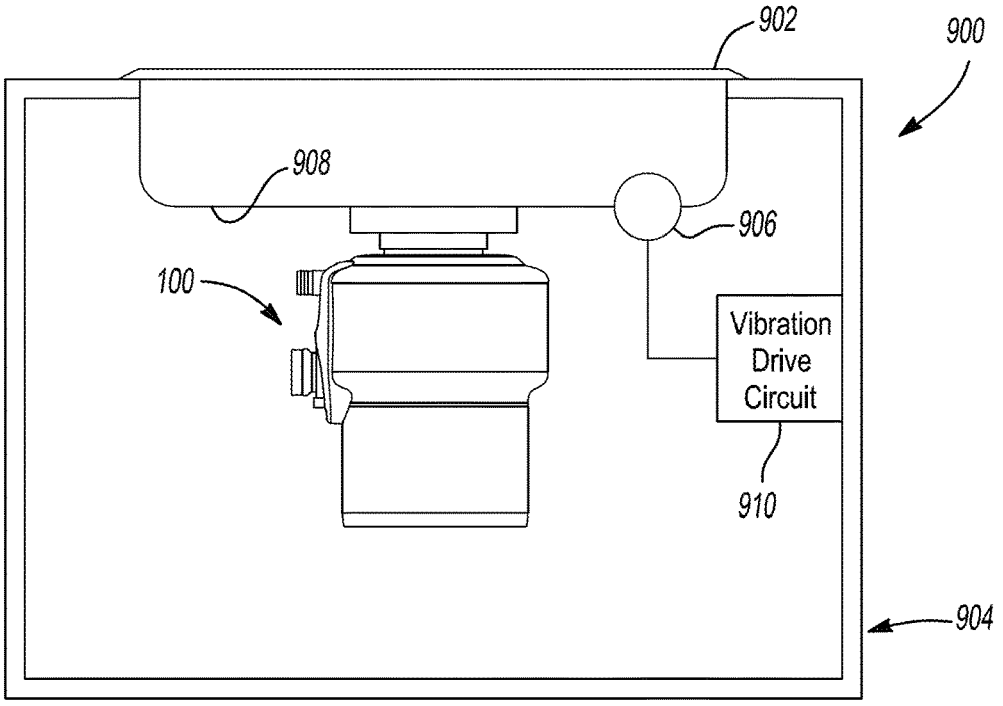
Figure 10:
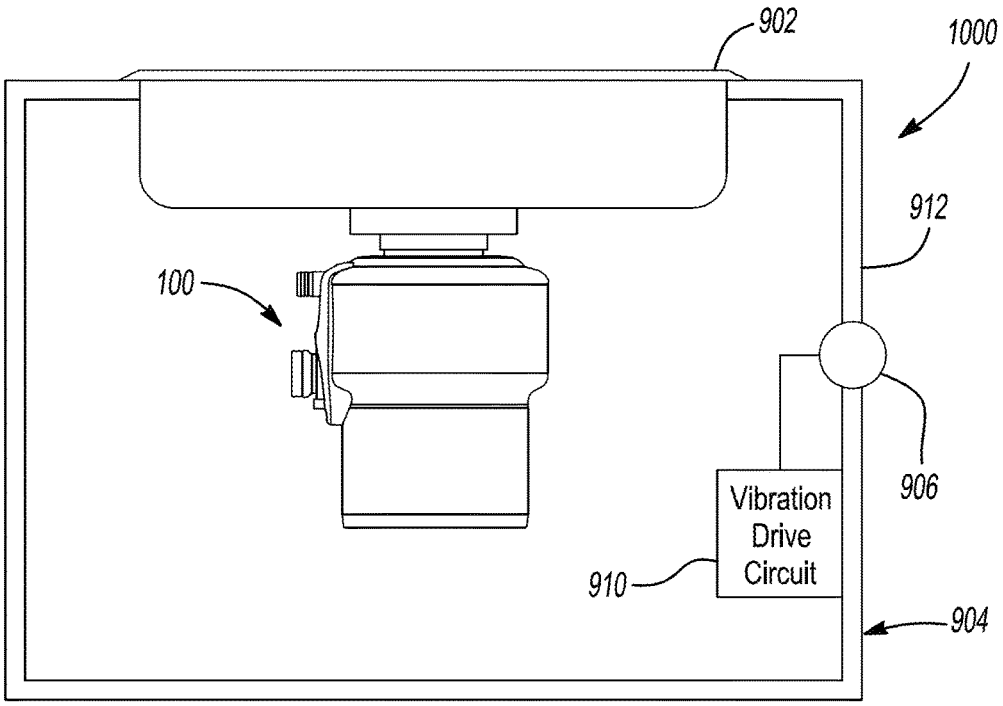

FIG. 9 is a perspective view of a food waste disposer system having active noise control in which active noise sound waves are generated by a vibration transducer in contact with a wall of a sink to which the food waste disposer is mounted in accordance with another aspect of the present disclosure; and FIG. 10 is a perspective view of a food waste disposer system having active noise control in which active noise sound waves are generated by a vibration transducer in contact with a wall of a cabinet in which the food waste disposer is disposed in accordance with another aspect of the present disclosure

DETAILED DESCRIPTION

Example embodiments will now be described more fully with reference to the accompanying drawings.

In accordance with an aspect of the present disclosure, active noise control is used to reduce noise of a food waste disposer. Active noise control can include noise masking and/or noise cancellation. Noise masking involves generating a broad spectrum noise field with a frequency content and amplitude that effectively "masks" or covers up annoying noises emanating from the food waste disposer. Noise masking does not actually reduce the amount of noise, but instead distracts the operator from being annoyed by the sound of the food waste disposer. Noise cancellation is the superposition of a canceling sound wave with the sound wave emanating from the disposer. The canceling sound wave is essentially the negative of the propagating sound wave (opposite phase) so that when the propagating sound wave and the canceling sound wave are superimposed, the result is a zero to low level sound.

Applying active noise control to the food waste disposer involves measuring the sound to be cancelled or masked, generating the appropriate cancelling or masking signal, and then playing that signal through a speaker located in or near the food waste disposer. In the case of effective global noise cancelling the noise is cancelled at the source (disposer) and this reduces the overall loudness at any location in the household. In the case of noise masking, it is preferable to minimize the amount of dynamics in the masking signal in order to reduce likelihood that the operator will notice its presence. The amounts of active noise canceling and sound masking can both be manipulated with a high degree of accuracy.

Figure 3:
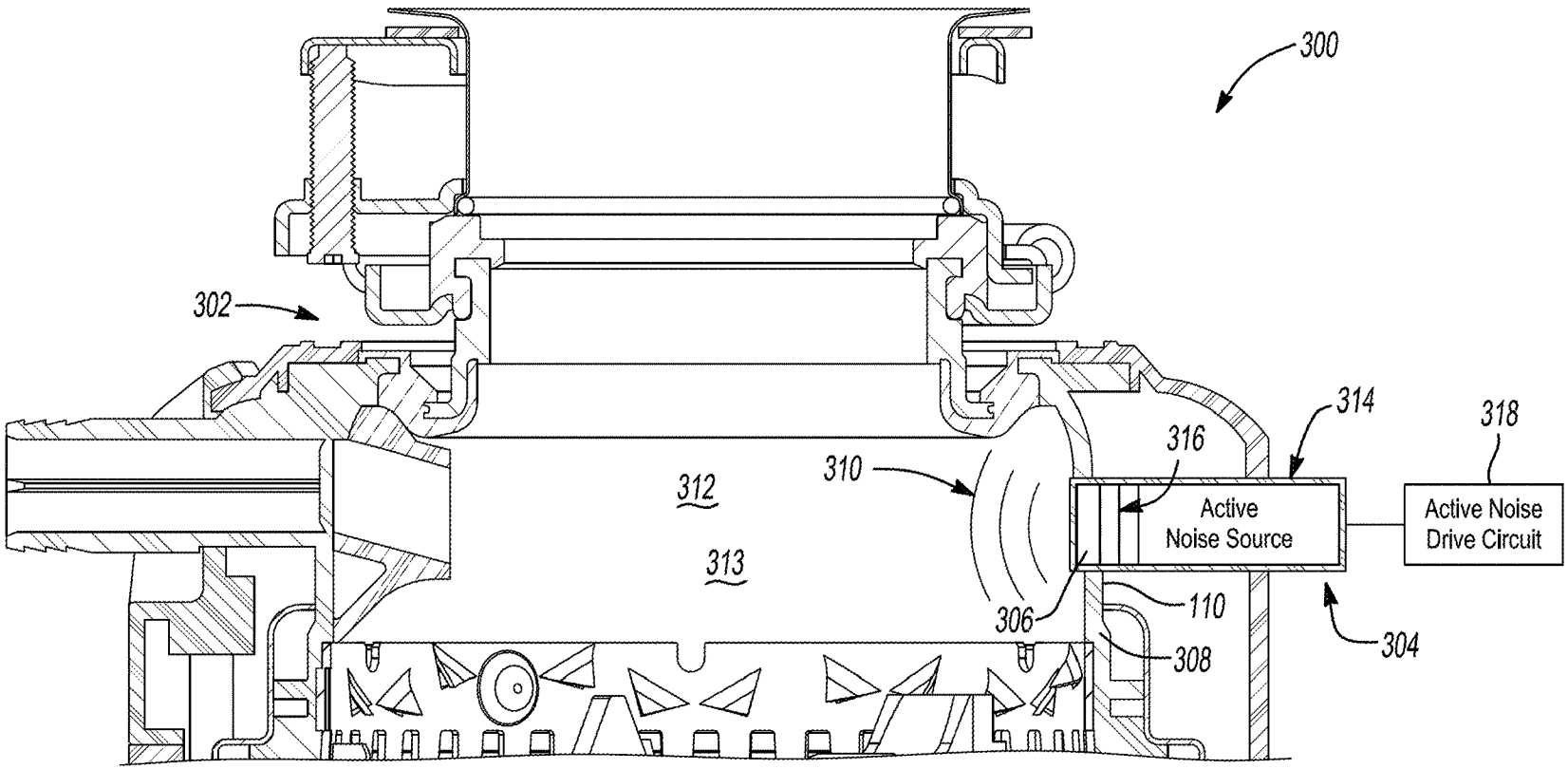
FIG. 3 is a sectional view of an upper portion of a food waste disposer system having active noise control with an active noise source disposed in a wall of a conveying housing of a food conveying section of the food waste disposer in accordance with an aspect the present disclosure.

Referring to FIG. 3, a food waste disposer system 300 having active noise control is shown. Food waste disposer system 300 includes a food waste disposer 302 having an active noise source 304 that radiates active noise sound waves into an area where food waste disposer noise generated when a motor of the food waste disposer is running is to be controlled. Illustratively, food waste disposer 302 is the same as food waste disposer 100 except for the addition of active noise source 304 and the following discussion will focus on the differences. In the example of FIG. 3, a portion 306 of active noise source 304 extends through a wall 308 of conveying housing 110 of food conveying section 102 and radiates active noise sound waves 310 into an interior 312 of food conveying section 102 with the interior 312 constituting an area 313 in which the food waste disposer noise is to be controlled. Portion 306 is illustratively an end portion of active noise source 304 and will hereafter be referred to as end portion 306. Active noise source 304 is disposed in a protective housing 314 with a protective membrane 316 at end portion 306 of active noise source 304. Active noise source 304 is coupled to an active noise drive circuit 318 that drives active noise source 304. Active noise source 304 is illustratively an audio transducer and may for an example be an audio speaker but can be other types of audio transducers such as piezoelectric audio transducers. Active noise drive circuit 318 is for an example a circuit including a signal generator and audio amplifier that amplifies an output of the signal generator. In an aspect, active noise drive circuit is programmable as to frequency, amplitude, or both.

In an aspect, active noise circuit 318 adaptively programs itself to function in frequency ranges which are prevalent in the system. In an aspect, active noise circuit 318 utilizes feedback control, in an aspect, active noise circuit uses feed forward control, and in an aspect, active noise circuit utilizes a combination of feedback and feed forward control.

As an example and not by way of limitation, active noise circuit 318 is configured, such as by programming, to implement a control methodology commonly known to those of skill of the art as Filtered-X least means squared feedforward control. The Filtered-X indicates that a source signal is passed through an adaptive finite impulse response signal to form the control signal. Initially, the filter coefficients are set to zeros, and then the control algorithm adapts the filter to minimize the error signal at each step, which is how control of impulsive signals is achieved. The filter is illustratively designed to function in a certain frequency range, such as a 120 Hz peak or less than 1000 Hz.

Figure 4:
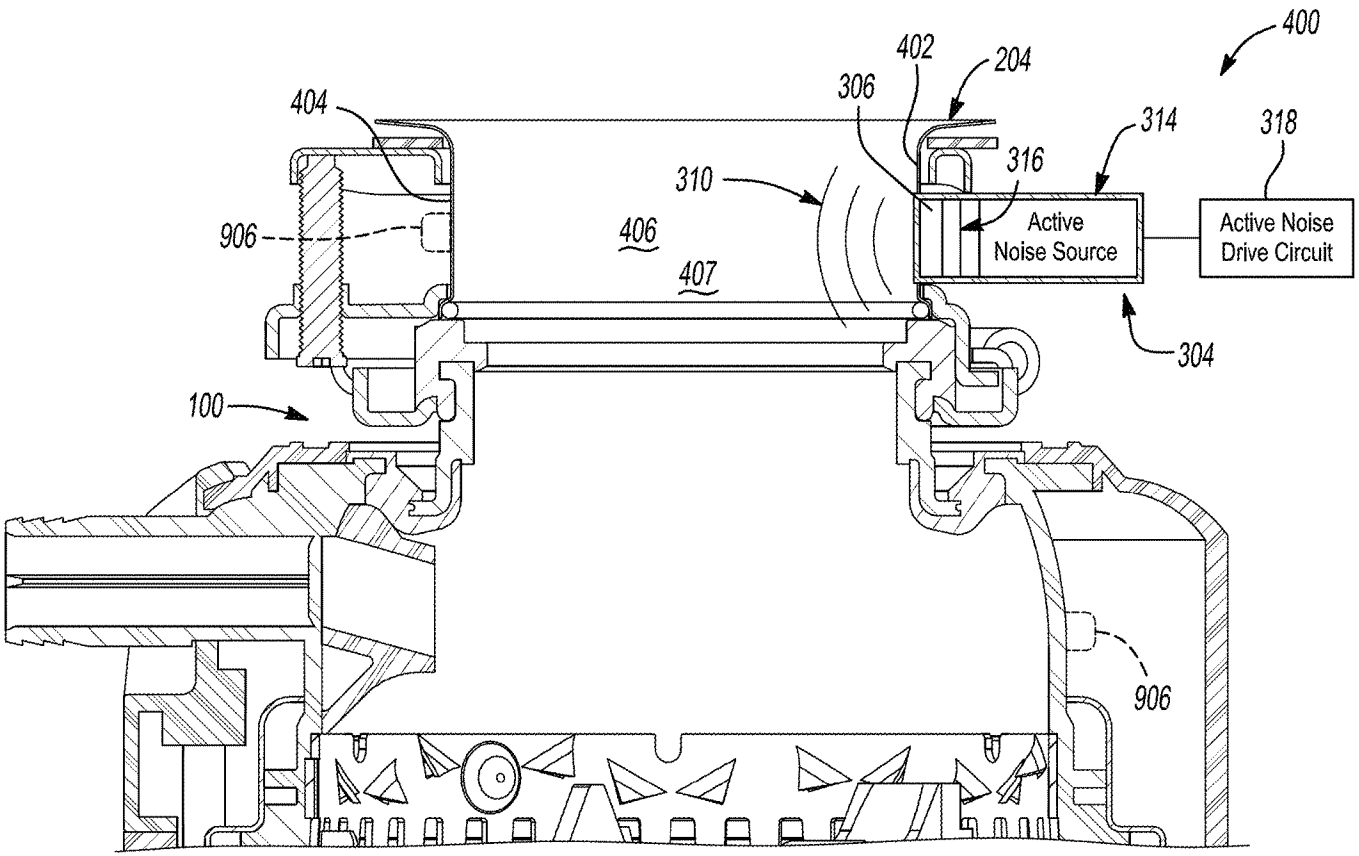
FIG. 4 is a sectional view of an upper portion of a food waste disposer system having the active noise source disposed in a wall of a tubular body of a sink flange to which the food waste disposer is attached accordance with another aspect the present disclosure.

With reference to FIG. 4, in an aspect, a food waste disposer system 400 has end portion 306 of active noise source 304 extending through a wall 402 of a tubular body portion 404 of sink flange 204 to which food waste disposer 100 is mounted. Active noise source 304 radiates active noise sound waves 310 into an interior 406 of tubular body portion 404 as shown in FIG. 4 with the interior 406 being an area 407 in which the food waste disposer noise is to be controlled.

Figure 5:
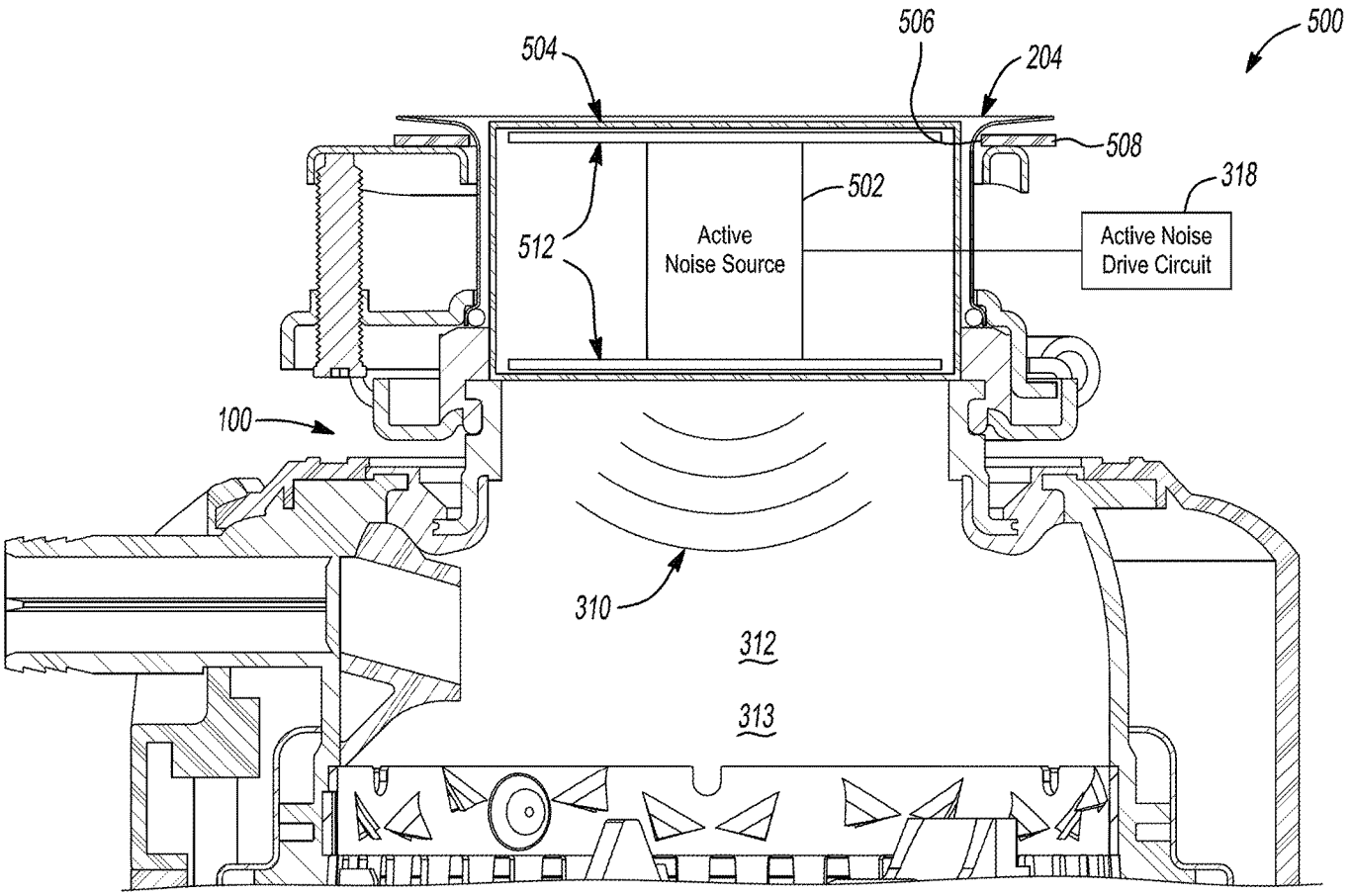
FIG. 5 is a sectional view of an upper portion of a food waste disposer system having the active noise source disposed in a stopper received in a drain opening of a sink to which the food waste disposer is mounted in accordance with another aspect the present disclosure.

With reference to FIGS. 5, in an aspect, a food waste disposer system 500 has an active noise source 502 disposed in a stopper 504 that is received in a sink drain outlet 506 of a sink 508 in which sink flange 204 to which food waste disposer 100 is mounted is received. It should be understood that stopper 504 is received in sink drain outlet 506 by being received in sink flange 204 which is received in sink drain outlet 506. In an aspect, active noise source 502 is disposed between protective membranes 512 that are also disposed in stopper 504. Active noise source 502 is illustratively also an audio transducer and is coupled to active noise drive circuit 318. In the aspect shown in FIG. 5, the active noise source 502 is disposed in stopper 504 to radiate active noise sound waves 310 into interior 312 of the food conveying section 102 of food waste disposer 100. In an aspect, stopper 504 is a stopper of the type described in U.S. Pat. No. 9,145,666 the entire disclosure of which is incorporated herein by reference.

Figure 6:
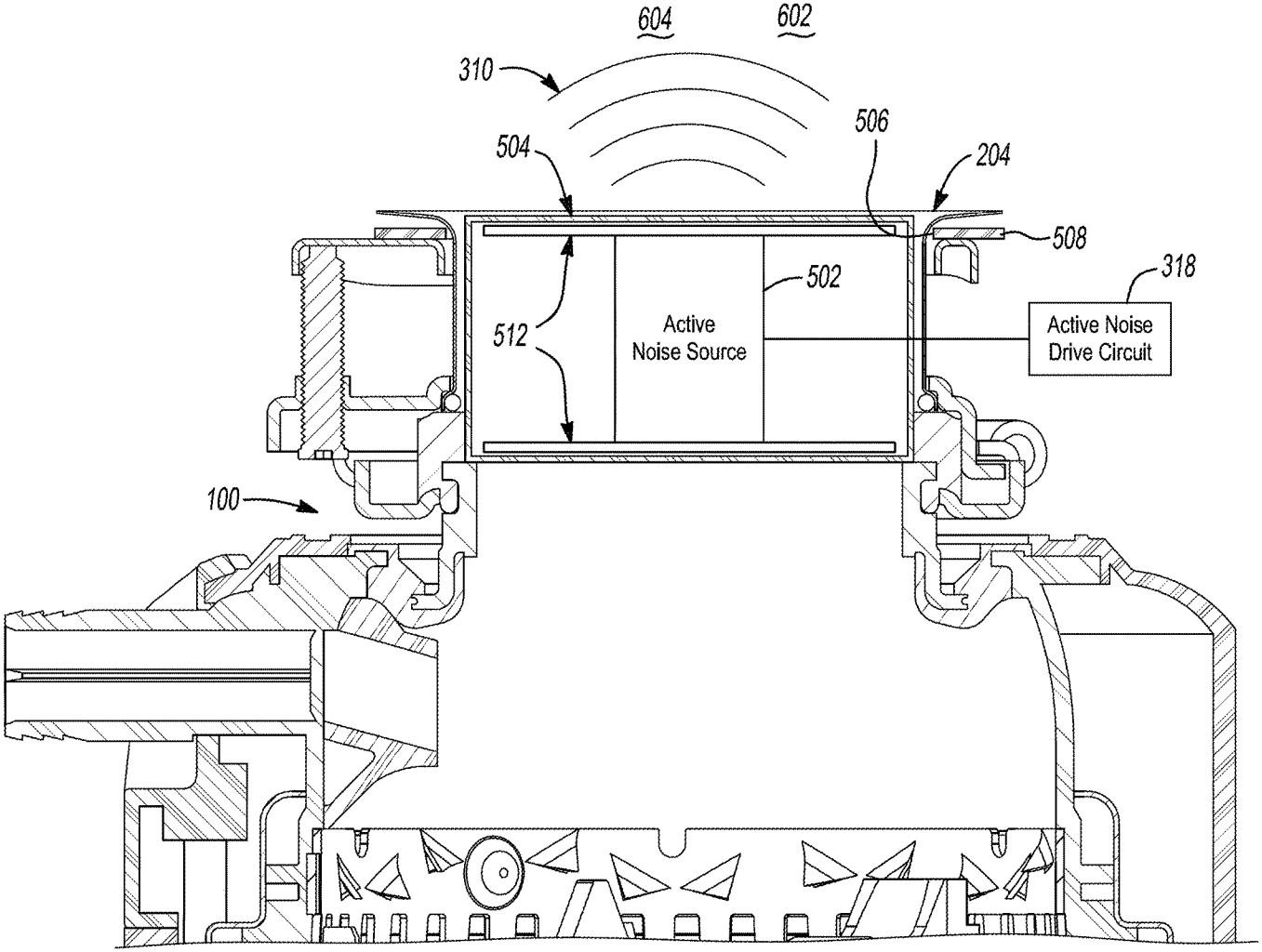
FIG. 6 is a sectional view of an upper portion of a variation of the food waste disposer system of FIG. 5 in which the active noise source is disposed to radiate active noise sound waves to an area above an inlet at an upper end of the food waste disposer in accordance with another aspect of the present disclosure.

In a variation of the food waste disposer system of FIG. 5, active noise source 502 disposed in stopper 504 radiates active noise sound waves 310 to an area 602 (FIG. 6) external to food waste disposer 100. In an aspect, area 602 is an area 604 above an inlet 109 at the upper end of food waste disposer 100 and the active noise source is disposed in stopper 504 to radiate active noise sound waves 310 into the area 604 above inlet 109.

Figure 7:
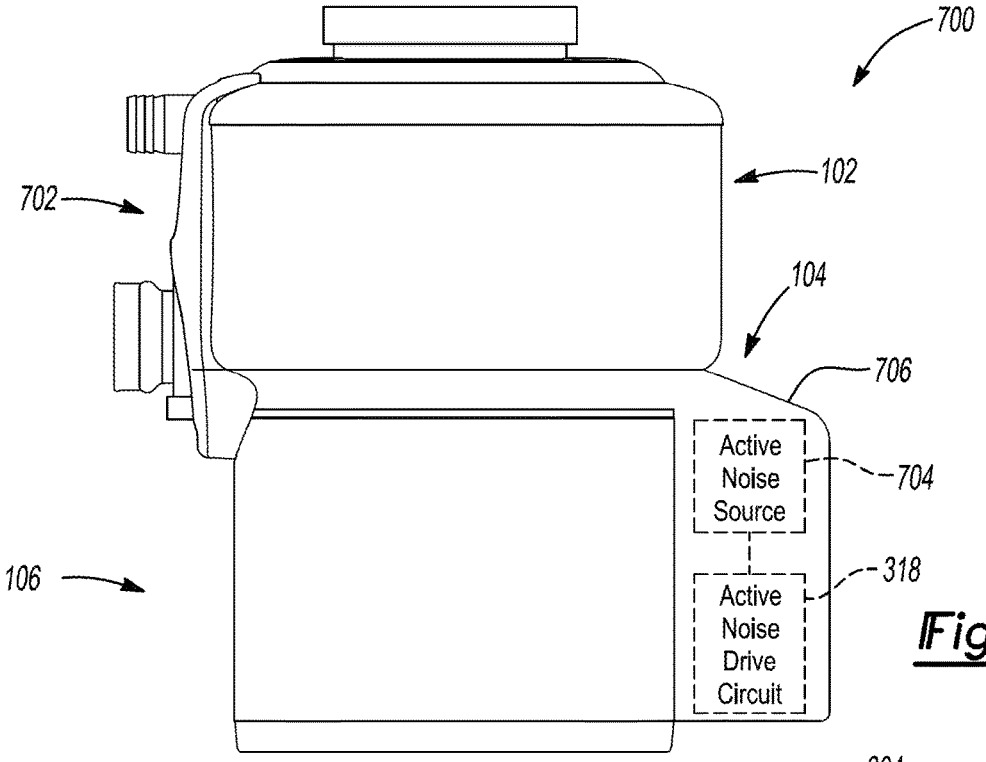
FIG. 7 is a perspective view of a food waste disposer system having an active noise source disposed in a housing attached to the motor section of the food waste disposer in accordance with another aspect of the present disclosure.

With reference to FIG. 7, in an aspect, a food waste disposer system 700 includes a food waste disposer 702 having an active noise source 704 and active noise drive circuit 318 disposed in a housing 706 attached to motor section 106. It should be understood that housing 706 could be attached to other sections of food waste disposer 702, such as upper food conveying section 102 or central grinding section 104.

Figure 8:
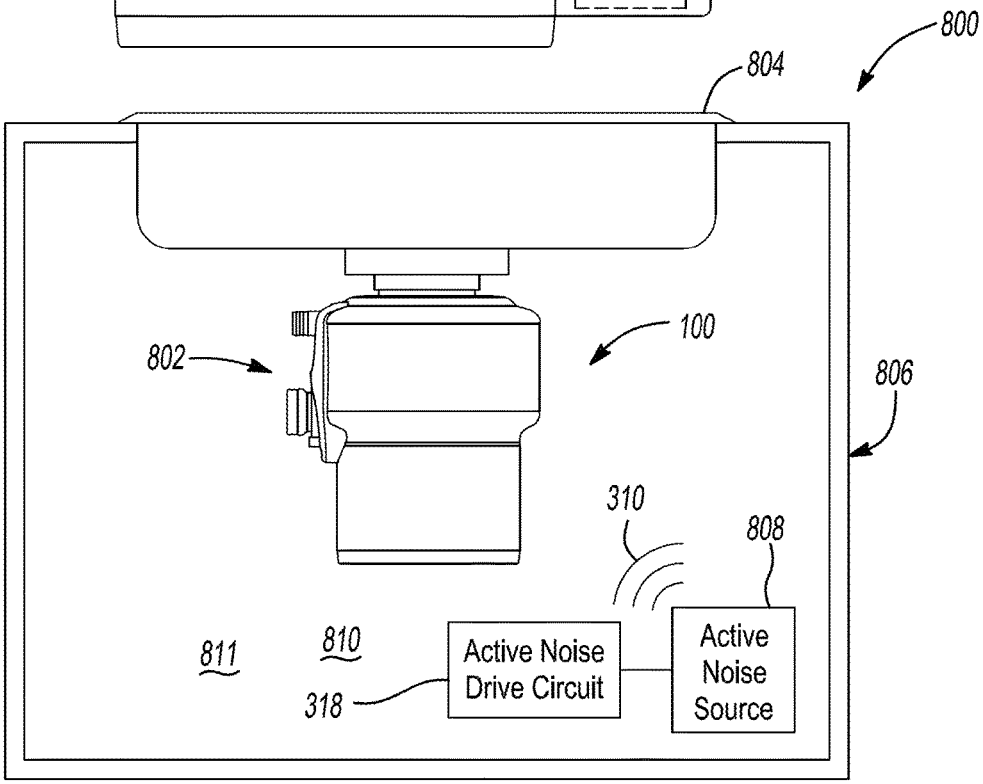
FIG. 8 is a perspective view of a food waste disposer system having an active noise source disposed in a cabinet in which the food waste disposer is disposed.

With reference to FIG. 8, a food waste disposer system 800 includes food waste disposer 100 mounted to a sink 804 with food waste disposer 802 disposed in a cabinet 806 with sink 804 received in a top of cabinet 806. An active noise source 808 is spaced from the food waste disposer 802 in cabinet 806 and radiates active noise sound waves 310 into an interior 810 of cabinet 806 with interior 810 being an area 811 in which the food waste disposer noise is to be controlled.

In each of the foregoing aspects, it should be understood that more than one active noise source can be used with the different active noise sources located at different ones of the above described locations.

In an aspect, vibration excitation could also be used to generate the cancelling or masking noise. Vibrational excitation of either the cabinet or sink can cause the cabinet or sink to radiate noise. Stainless steel kitchen sinks which are used in the majority of US households are effective radiators of sound. The sink itself acts as a speaker and when excited by a vibration signal, will radiate sound. Thus, in an aspect, an alternative means of creating a masking or cancelling signal for the operational noise of the food waste disposer is to use the structural response of the sink to a vibrational source as the source to generate the needed signal, use the structural response of the cabinet to a vibrational source as the source to generate the needed signal, or both. A drawback of this approach is that sink and cabinet characteristics are variable from installation to installation so the effectiveness of these alternatives may be site dependent. In this approach, an adaptive control method would be used and the adaptive nature of the control method will try to achieve noise cancellation within the means of the vibration source but there will be some range of system parameters (stiffness, damping) where the system would not be able to perform, but it will try to adapt to the site conditions as much as possible. FIGS. 9 and 10 show examples of the foregoing aspects.

With reference to FIG. 9, a food waste disposer system 900 has food waste disposer 100 mounted to a sink 902. Food waste disposer 100 is illustratively disposed in a cabinet 904 with sink 902 received in a top of cabinet 904. A vibration transducer 906 is in contact with a wall 908 of sink 902. Vibration transducer 906 is coupled to a vibration drive circuit 910. Vibration transducer 906, driven by vibration drive circuit 910, vibrates wall 908 of sink 902 at an applicable frequency to generate the active noise sound waves. Vibration transducer 906 is for example a piezoelectric transducer, but can be other types of transducers that vibrate in response to an electrical drive signal.

With reference to FIG. 10, a food waste disposer system 1000 has food waste disposer 100 mounted to a sink 902. Food waste disposer 100 is illustratively disposed in cabinet 904 with sink 902 received in the top of cabinet 904. A vibration transducer 906 is in contact with a wall 912 of cabinet 904. Vibration transducer 906 is coupled to vibration drive circuit 910. Vibration transducer 906, driven by vibration drive circuit 910, vibrates cabinet wall 912 at an applicable frequency to generate the active noise sound waves.

It should be understood that the vibration transducer could be located at locations other than wall 908 of sink 902 or cabinet wall 912. For example, vibration transducer 906 could be disposed in wall 308 of conveying housing 110 instead of active noise source 318 or in wall 402 of tubular body portion 404 of sink flange 204 (shown in phantom in FIG. 4). In these examples, wall 308 of conveying housing 110 or wall 402 of tubular body portion 404 of sink flange 204 are vibrated to generate the active noise sound waves.

Figure 1:
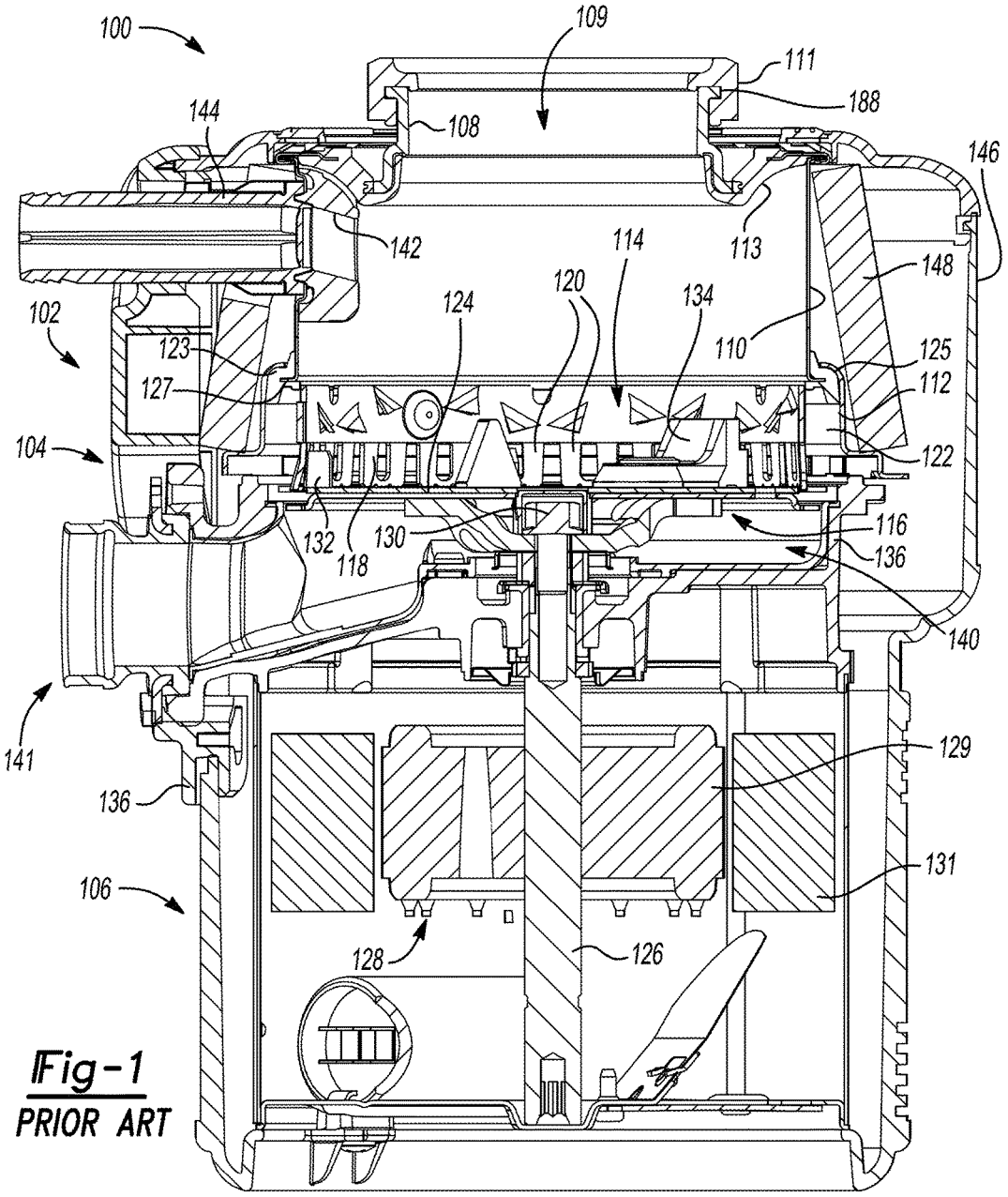
Fig-1 PRIOR ART
FIG. 1 is a sectional view of a prior art food waste disposer.
Figure 2:
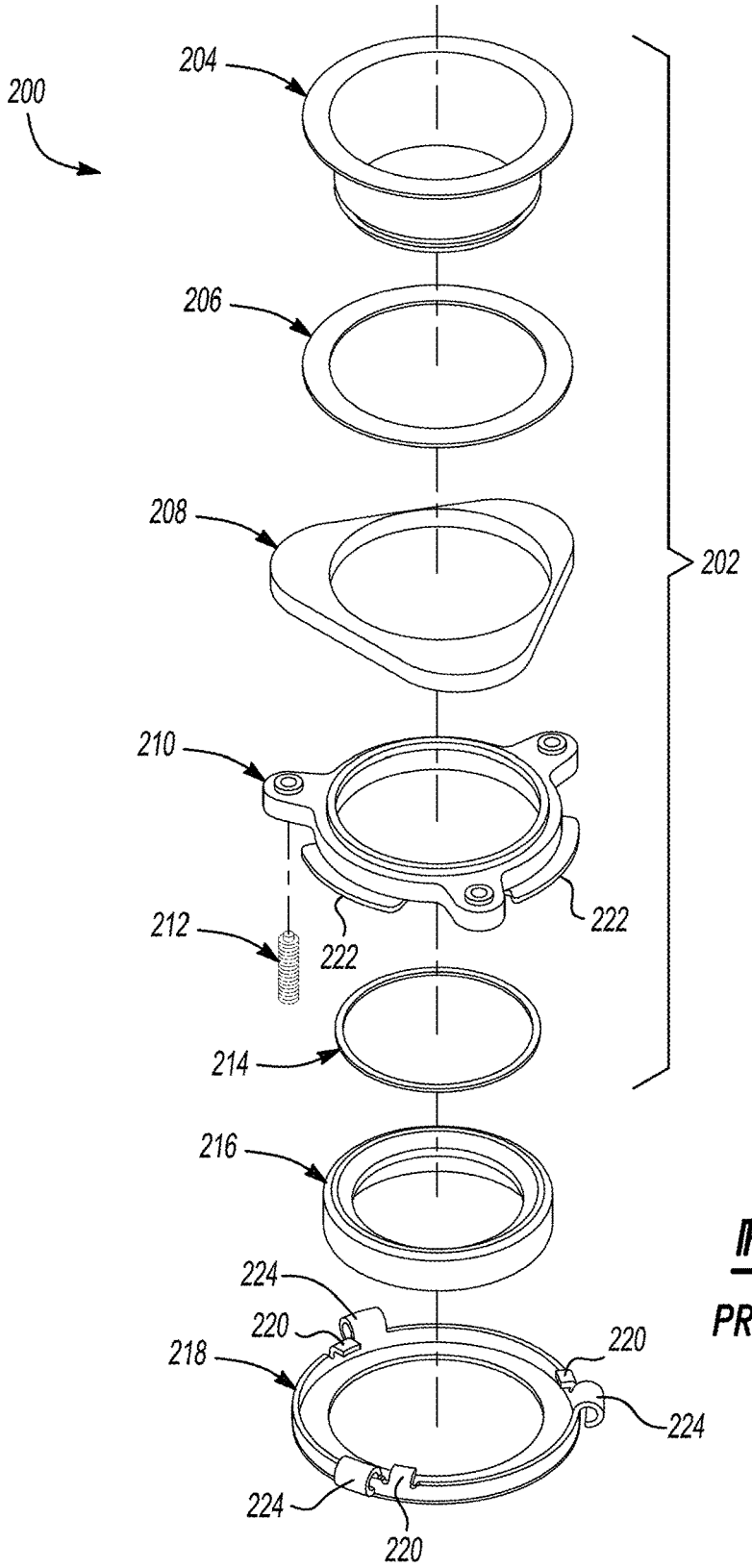
Fig-2 PRIOR ART
FIG. 2 is an exploded view of a prior art mounting assembly for mounting a food waste disposer to a sink.

It should be understood that in each of the above described aspects, the food waste disposer can have a layer of sound insulation such as sound insulation 148 (FIG. 1) or not have it.

It should be understood that active noise drive circuit 318 or vibration drive circuit 910 may be, be part of, or include an Application Specific Integrated Circuit (ASIC); an electronic circuit; a combinational logic circuit; a field programmable gate array (FPGA); a processor (shared, dedicated, or group) that executes code; a programmable logic controller, a programmable control system such as a processor based control system including a computer based control system, a process controller such as a PID controller, a digital signal processor, or other suitable hardware components that provide the described functionality or provide the above functionality when programmed with software implementing the logic described herein; or a combination of some or all of the above, such as in a system-on-chip. The term software, as used herein, may refer to computer programs, routines, functions, classes, and/or objects and may include firmware, and/or microcode. When it is stated that active noise drive circuit 318 or vibration drive circuit 910 performs a function, it should be understood that active noise drive circuit 318 or vibration drive circuit 910 is configured to do so such as by appropriate software, electronic circuit(s) including discrete and integrated logic, or combination thereof.

Applying active noise cancellation to the operational noise of a food waste disposer may make it feasible for either the manufacturer or the user themselves to select how loud they would like to the food waste disposer to be when operating. It is possible that the user may want to hear some low level noise from the disposer during operation so that they know it is working. Being able to customize the degree of active noise cancellation, particularly for the user, would make it possible to adjust the noise as activity in the home warrants. On the other hand, the manufacturer could tune the active noise cancellation so that the effectiveness is differentiated by model similar to current product differentiation in the disposer line. Further, masking noise could be introduced along with the active cancellation to mask higher frequency sounds which tend to be more difficult to actively attenuate. Similar to the active noise cancelling effectiveness, the spectral and temporal characteristics of masking noise could be manipulated by the manufacturer to further influence the operator's perception of the sound. Similarly, an operator selectable option to play music or some other type of sound over the noise of the disposer could be included to enhance the operator's awareness that the disposer was running and/or to mask the noise of the disposer.

Characteristics of the food waste disposer operational noise that make it suitable for active noise control are (1) on average the noise is tonal with dominating peaks less than 1000 Hz which is the most physically suitable frequency range for active noise cancellation, (2) the noise is time varying at a rate which is well within the active noise control controller adaptation rate and so can be tracked and cancelled in real time as the food waste disposer operates, and (3) an acoustic or vibration reference signal is available at the noise source which is coherent to the acoustic signal experienced or measured in the desired area of active noise cancellations.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of controlling food waste disposer noise that is generated by a food waste disposer when a motor of the food waste disposer is running, comprising:

providing the food waste disposer;

providing an active noise source configured to radiate active noise sound waves and having the active noise source positioned to radiate the active noise sound waves into an interior of a food conveying section of food waste disposer; and radiating with the active noise source active noise sound waves into the interior of a food conveying section of the food waste disposer at an amplitude and frequency to at least cancel or mask the food waste disposer noise.

2. The method of claim 1 wherein radiating the active noise sound waves includes radiating them at an amplitude and a frequency to both cancel and mask the food waste disposer noise.

3. The method of claim 1 wherein radiating the active noise sound waves includes radiating them through a portion of the active noise source that extends through a wall of a housing of the food conveying section.

4. The method of claim 1 wherein radiating the active noise sound waves includes radiating them with the active noise source disposed in a stopper received in a sink drain outlet of a sink to which the food waste disposer is mounted.

5. A method of controlling food waste disposer noise that is generated by a food waste disposer when a motor of the food waste disposer is running, comprising;

providing the food waste disposer;

providing an active noise source configured to radiate active noise sound waves and having the active noise source positioned to radiate the active noise sound waves into an interior of a tubular body of a sink flange to which the food waste disposer is mounted; and radiating with the active noise source active noise sound waves into the interior of a tubular body of a sink flange to which the food waste disposer is mounted at an amplitude and frequency to at least cancel or mask the food waste disposer noise.

6. The method of claim 5 wherein radiating the active noise sound waves includes radiating them through a portion of the active noise source that extends through a wall of the tubular body of the sink flange.

7. A method of controlling food waste disposer noise that is generated by a food waste disposer when a motor of the food waste disposer is running, comprising:

providing the food waste disposer;

providing an active noise source configured to radiate active noise sound waves and having the active noise source disposer in a stopper received in a sink drain outlet of a sink to which the food waste disposer is mounted; and radiating with the active noise source active noise sound waves into an area above an inlet at an upper end of the food waste disposer at an amplitude and frequency to at least cancel or mask the food waste disposer noise.

8. A method of controlling food waste disposer noise that is generated by a food waste disposer when a motor of the food waste disposer is running, comprising;

providing the food waste disposer;

providing an active noise source configured to radiate active noise sound waves and having the active noise source disposed in a cabinet in which the food waste disposer is disposed; and radiating with the active noise source active noise sound waves in an interior of the cabinet at an amplitude and frequency to at least cancel or mask the food waste disposer noise.

9. A method of controlling food waste disposer that is generated by a food waste disposer when a motor of the food waste disposer is running, comprising;

providing the food waste disposer;

generating active noise sound waves by vibrating with a vibrational source a wall of a sink to which the food waste disposer is mounted with the active noise sound waves at an amplitude and frequency to at least cancel or mask the food waste disposer noise.

10. A method of controlling food waste disposer noise that is generated by a food waste disposer when a motor of the food waste disposer is running, comprising;

providing the food waste disposer;

generating active noise sound waves by vibrating with a vibrational source a wall of a cabinet in which the food waste disposer is disposed with the active noise sound waves at an amplitude and frequency to at least cancel or mask the food waste disposer noise.

11. A method of controlling food waste disposer noise that is generated by a food waste disposer when a motor of the food waste disposer is running, comprising:

providing the food waste disposer;

generating active noise sound waves by vibrating with a vibration source a wall of a conveying housing of a food conveying section of the food waste disposer or vibrating with the vibrational source a wall of a tubular body portion of a sink flange to which the food waste disposer is mounted with the active noise sound waves at an amplitude and frequency to at least cancel or mask the food waste disposer noise.

12. A food waste disposer system with active noise control of food waste disposer noise that is generated by the food waste disposer when a motor of the food waste disposer is running, comprising:

a food waste disposer having a food conveying section that conveys food waste to a grinding section, the grinding section having a rotatable shredder plate that is rotated by a motor of a motor section; and an active noise source configured to radiate active noise sound waves and positioned to radiate the active noise sound waves into an interior of the food conveying section of the food waste disposer at an amplitude and frequency to at least cancel or mask the food waste disposer noise.

13. The food waste disposer system of claim 12 wherein the active noise source is configured to radiate the active noise sound waves at an amplitude and a frequency to both cancel and mask the food waste disposer noise.

14. The food waste disposer of claim 12 wherein the active noise source has a portion that extends through a wall of a housing of the food conveying section and from which the active noise sound waves are radiated.

15. The food waste disposer system of claim 12 including a stopper receivable in a sink drain opening of a sink to which the food waste disposer is mounted, the active noise source disposed in the stopper.

16. A food waste disposer system with active noise control of the food waste disposer noise that is generated by the food waste disposer when a motor of the food waste disposer is running, comprising;

a food waste disposer having a food conveying section that conveys food waste to a grinding section, the grinding section having a rotatable shredder plate that is rotated by a motor of a motor section; and an active noise source configured to radiate active noise sound waves at an amplitude and frequency to at least cancel or mask the food waste disposer noise wherein the active noise source is disposed to radiate the active noise sound waves into an interior of a tubular body of a sink flange to which the food waste disposer is mounted.

17. The food waste disposer system of claim 16 wherein the active noise source has a portion that extends through a wall of the tubular body of the sink flange and from which the active noise sound waves are radiated.

18. A food waste disposer system with active noise control of food waste disposer noise that is generated by the food waste disposer when a motor of the food waste disposer is running, comprising;

a food waste disposer having a food conveying section that conveys food waste to a grinding section, the grinding section having a rotatable shredder plate that is rotated by a motor of a motor section; and an active noise source configured to radiate active noise sound waves at an amplitude and frequency to at least cancel or mask the food waste disposer noise; and a stopper receivable in a sink drain outlet of a sink to which the food waste disposer is mounted, the active noise source disposed in the stopper to radiate the active noise sound waves to an area above the inlet at the upper end of the food waste disposer.

19. A food waste disposer system with active noise control of food waste disposer noise that is generated by the food waste disposer when a motor of the food waste disposer is running, comprising;

a food waste disposer having a food conveying section that conveys food waste to a grinding section, the grinding section having a rotatable shredder plate that is rotated by a motor of a motor section; and an active noise source configured to radiate active noise sound waves at an amplitude and frequency to at least cancel or mask the food waste disposer noise; and the active noise source is disposer in a cabinet in which the food waste disposer is disposed and radiates the active noise sound wave in an interior of the cabinet.

20. A food waste disposer system with active noise control of food waste disposer noise that is generated by the food waste disposer when a motor of the food waste disposer is running, comprising:

a food waste disposer having a food conveying section that conveys food waste to a grinding section, the grinding section having a rotatable shredder plate that is rotated by a motor of a motor section; and a vibration transducer in contact with a wall of a sink to which the food waste is mounted and configured to generate active noise sound waves at an amplitude and frequency to at least cancel or mask the food waste disposer noise by vibrating the wall of the sink.

21. A food waste disposer system with active noise control of food waste disposer noise that is generated by the food waste disposer when a motor of the food waste disposer is running, comprising:

a food waste disposer having a food conveying section that conveys food waste to a grinding section, the grinding section having a rotatable shredder plate that is rotated by a motor of a motor section; and a vibration transducer in contact with a wall of a cabinet in which the food waste disposer is disposed and configured to generate active sound waves at an amplitude and frequency to at least cancel or mask the food waste disposer noise by vibrating the wall of the cabinet.

22. A food waste disposer system with active noise control of food waste disposer noise that is generated by the food waste disposer when a motor of the food waste disposer is running, comprising;

a food waste disposer having a food conveying section that conveys food waste to a grinding section, the grinding section having a rotatable shredder plate that is rotated by a motor of a motor section; and a vibration transducer configured to generate active sound waves at an amplitude and frequency to at least cancel or mask the food waste disposer noise;

the vibration transducer in contact with wall of a conveying housing of a food conveying section of the food waste disposer and the active sound waves generated by the vibration transducer vibrating the wall of the conveying housing, or the vibration transducer in contact with a wall of a tubular body portion of a sink flange to which the food waste disposer is mounted and the active sound waves generated by the vibration transducer vibrating the wall of the tubular body portion.

* * * * *